United States Patent [19]

Engel

[11] Patent Number: 4,731,711

[45] Date of Patent: Mar. 15, 1988

[54] LIGHTING SYSTEM

[76] Inventor: Hartmut S. Engel, Schloss Heutingsheim, 7141 Freiberg am Neckar, Fed. Rep. of Germany

[21] Appl. No.: 875,616

[22] Filed: Jun. 18, 1986

[30] Foreign Application Priority Data

Jun. 19, 1985 [DE] Fed. Rep. of Germany ..... 3521910

[51] Int. Cl.[4] ..... F21V 7/00

[52] U.S. Cl. ..... 362/147; 362/247; 362/404; 174/48; 439/226

[58] Field of Search ..... 339/57, 157 C, 154, 339/52 R, 24; 307/147; 313/49, 51, 113, 114; 174/48; 362/296, 219, 364, 365, 404, 147, 247, 225, 407, 227, 368

[56] References Cited

U.S. PATENT DOCUMENTS

| | | | |
|---|---|---|---|
| 1,954,591 | 4/1934 | Keith et al. | 362/247 |
| 3,381,123 | 4/1968 | Docimo | 362/366 |
| 3,539,969 | 11/1970 | Johnson et al. | 339/52 R |
| 3,619,602 | 11/1971 | Wilde | 362/219 |
| 3,715,627 | 2/1973 | D'Aucilio | 174/48 |
| 4,001,571 | 1/1977 | Martin | 362/225 |
| 4,430,694 | 2/1984 | Koivumaki et al. | 362/407 |
| 4,639,841 | 1/1987 | Salestrom et al. | 362/227 |

*Primary Examiner*—William A. Cuchlinski, Jr.
*Assistant Examiner*—D. M. Cox

[57] ABSTRACT

A lighting system is described which consists of a few basic units which can essentially be combined together in any desired sequence and which consist of spot lamps and also of stiff and flexible connecting members. Each spot lamp has two oppositely disposed sockets into which plug connectors provided at the ends of the connecting members can be inserted so that the spot lights can be joined in series or in arrays. The connecting members can also cooperate in defining the power connections.

17 Claims, 8 Drawing Figures

LIGHTING SYSTEM

Figure 1:
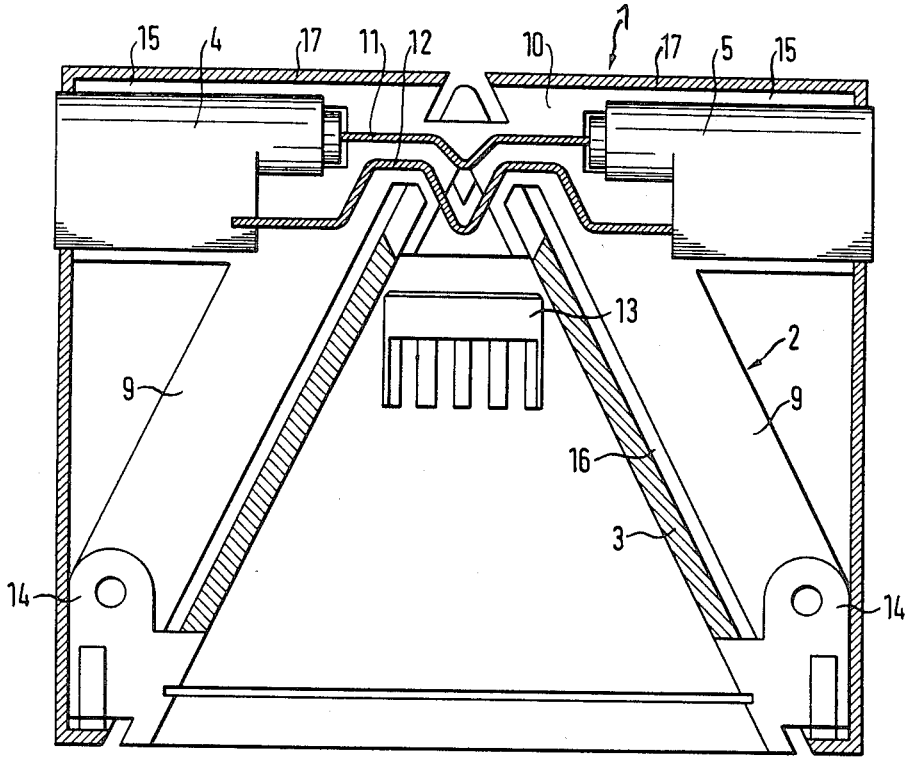

The invention relates to a lighting system consisting of basic units which can be put together in accordance with the modular construction principle and which have the form of spot lights, in particular spot lights which can be equipped with halogen lamps, and of mechanically supporting connecting members which simultaneously form the power supply lines.

Known lighting systems of this kind offer only very restricted possibilities for varying their layout which is generally restricted to changing the spacing between a basic lamp element and a spot lamp or reflector, or of displaceably arranging the spot lights in a rail system.

The principal object underlying the present invention is to provide a lighting system which makes it possible, using a minimum of basic units, to realise the most diverse lighting arrangements in a simple and uncomplicated manner, so that the user of the system has available the most diverse possibilities for varying the lighting in a form which can always be modified.

This object is satisfied in accordance with the invention essentially in that each spot light has two diametrically oppositely disposed and identically constructed mounts for plug couplings, with the mounts being electrically connected with each other; and in that each connecting member is provided, at least one of its ends with a tension relieved plug connector matched to the coupling mount.

The provision of a double connection with a throughgoing electrical connection provides the basis for the high degree of variability of the system of the invention.

The mounts for the plug couplings and the plug connectors are expediently formed in the manner of coaxial connectors and the oppositely disposed mounts of the spot light are integrated into a carrier part on which all further elements of the spot light are mounted. In this way a stable basic structure is prepared which always ensures the desired level of mechanical stability and leaves the required freedom with regard to the shaping of the spot lights.

In accordance with a preferred embodiment of a spot light the carrier part consists of a head part and two downwardly diverging limbs, with the electrical connection lines between the mounts for the plug couplings and to the lamp holder being provided in the head part. The limbs can expediently be made with a substantially flat rectangular cross-section and are connected in the vicinity of their free ends with holders for a reflector support arranged between the limbs which preferably has the shape of a cone, with a gap which contributes to ensuring an ideal dissipation of heat being provided between the limbs and the reflector support.

A narrow cover cap which can be plugged into place is preferably associated with each limb and the associated formation in which the mount for the plug coupling is accommodated, with the narrow cover cap having a triangular outline, with the height of the cover cap corresponding essentially to the height of the reflector support, with the base line of the triangle extending parallel to and spaced from a generator line of the reflector support, and with the outwardly disposed angle of the triangular cover cap being a right angle.

The use of these cover caps means that only the reflector support and the cover caps can be seen at each spot light so that all the technical elements can be designed exclusively in dependence on their function and independently of their appearance.

Both tube sections which are stiff in bending and also carrying cable elements which are connected with the plug connectors can be used as connection members. The tube sections which are stiff in bending and also the carrying cable elements can be made ready in different lengths, and the stiff tube sections can also be incorporated into the modular system with differently angled portions or angled branches.

Figure 2:
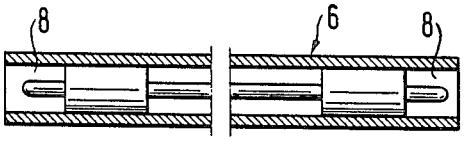
Figure 3:
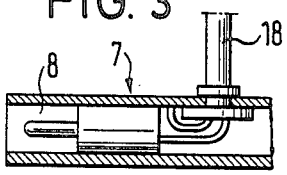

Further advantageous developments and features of the invention are set forth in the subordinate claims The invention will now be explained in the following with reference to embodiments and to the drawings in which are shows:

FIG. 1 a schematic sectional view to explain the basic construction of a spot light in accordance with the invention, FIG. 2 a schematic illustration of an example for a connecting member which is stiff in bending, FIG. 3 a schematic illustration to explain the construction of a connecting member constructed as a carrying cable element, and FIGS. 4 to 8 examples of possible combinations using the basic units of the modular system of the invention.

The modular system of the invention is preferably intended for low voltage halogen systems, can however fundamentally also be used with all other kinds of lighting systems, with it then merely being necessary to observe the relevant safety provisions in connection with the electrical couplings and to make correpsonding adaptations.

FIG. 1 shows a spot light designated with the general reference numeral 1. The spot light 1 includes a carrier part 2 of plastic material and also a reflector support 3. The carrier part 2 consists of a head part 10 and two limbs 9 which diverge downwardly starting from this head part 10, with the reflector support 3 being secured via mounts 14 to the free ends of the limbs 9. The reflector support 3 preferably consists of metal and is formed in the shape of a cone which is provided with a cut-out in the region of the apex of the cone, with the head part engaging into this recess. The cut-out simultaneously favours the leading away of heat in operation.

A lamp holder 13 which is expediently simultaneously constructed as a cooling body is arranged in the reflector support 3 and is schematically illustrated in FIG. 1. A gap 16 is provided between the reflector support 3 and the limbs 9, which extend parallel to the generating line for the conical reflector support 3. This gap 16 ensures that the thermal loading of the carrier or support part remains low.

The head part has formations or parts 15 disposed in the plane of the limbs, which are constructed as shallow beams, and sockets or mounts 4, 5 for accommodating plugged couplings are integrated in form-locked manner into the formations or parts 15. The mounts or sockets 3, 5 are fixed by fixing means which are not shown.

The mounts or sockets 4, 5 for the plug couplings each consist of two metal half shells which can be clamped together and which are constructed in the manner of a coaxial plug part with the inner conductor 11 being separated via an insulating part from the outer conductor which is formed by the metal housing itself.

The inner conductors of the two mounts or sockets 4, 5 for the plug couplings are connected together via an electrical connection 11 and the outer conductors formed by the housings are connected together via an electrical line 12. Branches to the lamp holder connections of the spot light are provided approximately centrally but are not shown in the drawing.

Each limb 9 with the associated formation 15 is surrounded by a narrow cover cap 17 which has a triangular outline as seen in side elevation in the drawing. The cover caps are of essentially rectangular or C-shaped cross-section, i.e. a section in a plane perpendicular to the plane of FIG. 1 to the central axis of the spot light. This cover cap is preferably fixed via snap locking connectors.

These cover caps 17 leave only the mounts or sockets 4, 5 for the plug couplings free towards the outside but cover all other technical elements so that the outer appearance of the spot light is determined only by the conical reflector support 3 and the narrow cover cap 17 which extends in accordance with a central plane. The outer contour of the cover cap 17 is triangular and the dimension of it is so selected that the spot light 1 has a rectangular peripheral contour or outline in sideview.

FIG. 2 shows the basic construction of a connecting member in the form of a tubular section 6 which is stiff in bending. With this arrangement both plug connectors 8 are provided in the manner of a coaxial plug. I.e. the plug connector 8 has a central pin 8' which is electrically insulated by an insulator 8" from the outer sleeve 8''' which forms the other electrical connection. In use the outer sleeve 8''' contacts the metal shells of the mounts 4, 5, and thus the connecting line 12, and the central pin 8" contacts the line 11 (or a tubular socket connected therewith. In this arrangement plug connections 8 in the form of a coaxial plug are provided at both ends. The internal contacts are connected together in the customery manner via a flexible line whereas the outer conductor is formed by the tube itself. This is straightforwardly possible with low voltage arrangements.

FIG. 3 shows a connecting member constructed as a support cable element 7 which is likewise provided with a plug connection, at least in the one end. A support cable 18 is led out radially from this plug connection and is relieved of tension. This type of connection with the plug connector merely represents one variant. Naturally the support cable can also be axially led out of the plug connector part for which purpose it is merely necessary to provide a corresponding termination element.

FIGS. 4 to 8 show in schematic manner various ways of combining the basic units of the modular system of the invention.

Figure 4:
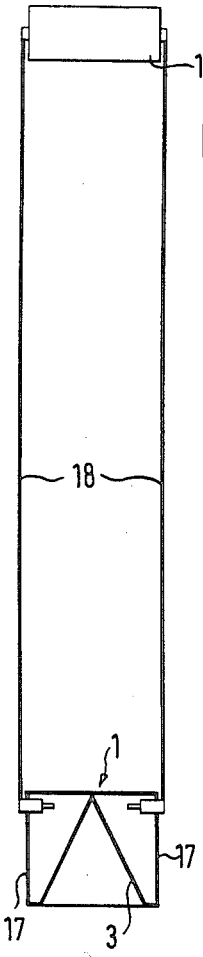

FIG. 4 shows a first embodiment of a suspended spot lamp wherein a transformer unit 19 is for example secured to the ceiling and is coupled with a spot light 1 via two connecting members in the form of carrying cable elements 18. The spot lamp 1 has the construction of FIG. 1 and the conical reflector carrier 3 and the two lateral cover caps 17 can be seen.

Figure 5:
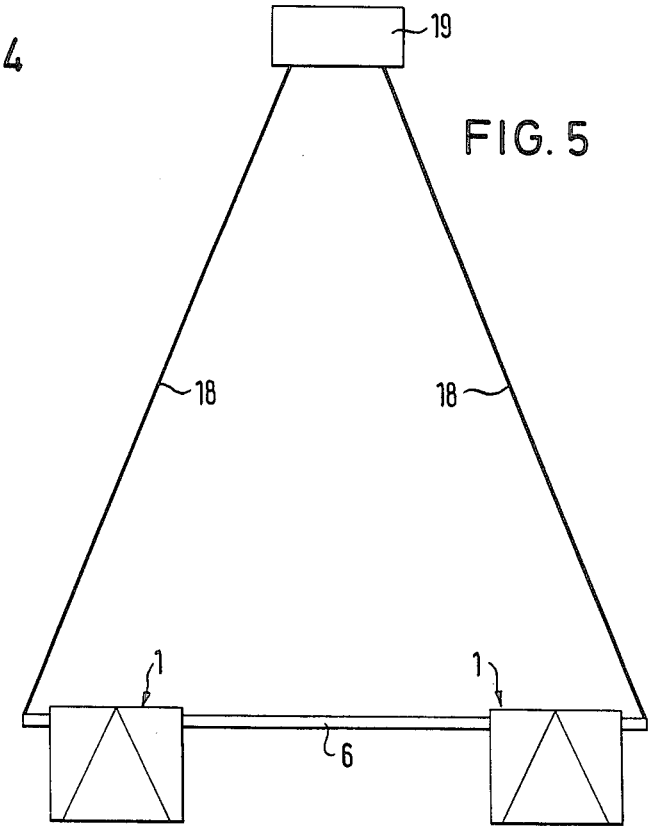

A modification of the arrangement of FIG. 4 is illustrated in FIG. 5 which shows a combination of two spot lamps 1, the mutual spacing of which is determined by a tubular connecting member 6. This double spot lamp arrangement is in turn mounted to a basic part, preferably to a transformer 19 via two carrying cable members 18 which simultaneously form the electrical feed lines.

Figure 6:
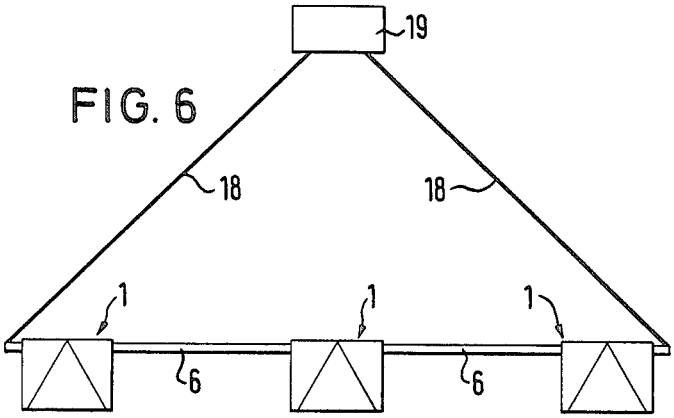

In the embodiment of FIG. 6 three lamps 1 are mounted via carrying cable elements 18 and the mutual spacing of the spot lamps is determined by two tubular connectors 6 which are stiff in bending. From the electrical point of view the lamps are connected in series via the connecting members 6, 18.

It is evident that the most diverse spot lamp arrangements can be provided through this coupling principle which is shown with reference to FIGS. 5 and 6, with large area structures and structures which are effective in mutually displaced planes being capable of being realised by the use of angled connecting members 6. I.e. two or even those dimensional arrays of spot lamps are possible using the basic spot light module and branched or angled connection members.

Figure 7:
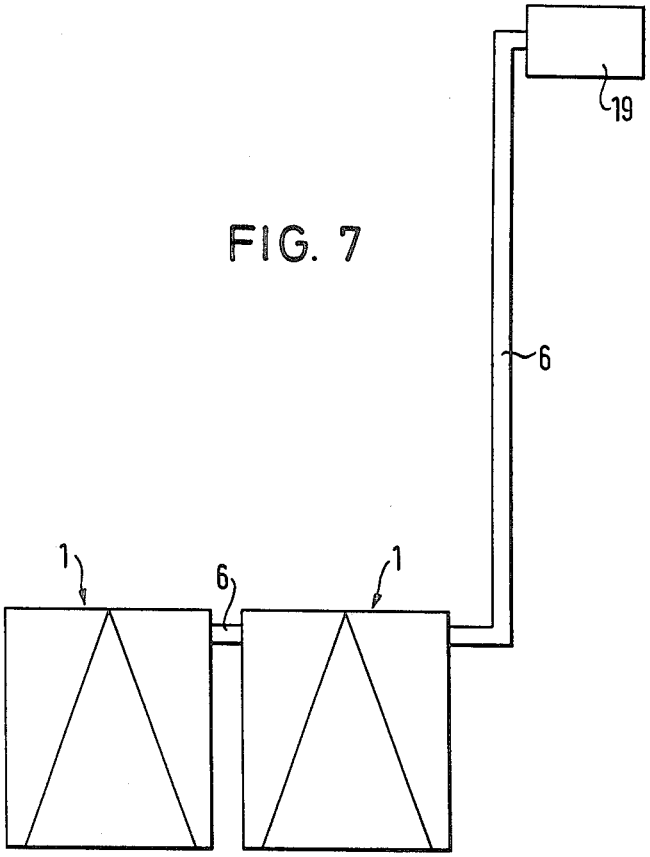

FIG. 7 shows a double spot lamp arrangement in which the two spot lamps 1 are mechanically and electrically coupled together via a connecting member 6 which is of very short construction. This double spot lamp arrangement is mounted relative to a transformer 9 which is to be fixed to the wall or to the ceiling by means of a stiff carrier member 6 of angled shape.

Figure 8:
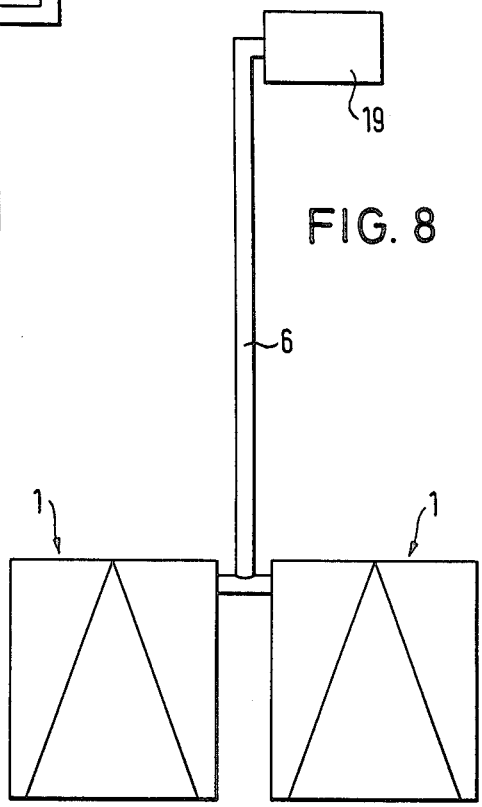

Whereas in the embodiment of FIG. 7 the connecting member 6 is attached at the side the variant of FIG. 8 shows a connecting member 6 which is T-shaped at one end and which enables a central connection between the two spot lamps 1.

I claim:

1. A modular lighting system including at least one spotlight unit and mechanical support means therefor, said mechanical support means including first and second power lines and having at least one end connectable to said spotlight unit and formed as a connection member, said spotlight unit comprising a carrier part, a lamp holder mounted on said carrier part, first and second diametrically oppositely disposed and substantially identically constructed mounts on said carrier part and adapted for connection to a said connection member of said mechanical support means, each said mount including first and second conductors, said first conductors of said first and second mounts and said second conductors of said first and second mounts being respectively electrically connected together and to said lamp holder, said connecting member being electrically and mechanically connectable with any one of said mounts, said connecting member and said mounts being constructed as respective elements of a plug and socket connector adapted in connected state to produce mechanical connection between said mechanical support means and said spotlight unit and electrical connection between said power lines and said first and second conductors.

2. A modular lighting system in accordance with claim 1, wherein said plug and socket connector formed by a said connecting member and a said mount is a coaxial plug and socket connector.

3. A modular lighting system in accordance with claim 1, wherein said carrier part comprises a head part and first and second downwardly diverging limbs, said first and second mounts being disposed on said head part, and wherein a reflector support of substantially conical shape is disposed between said limbs.

4. A modular lighting system in accordance with claim 3, wherein said limbs are essentially of flat rectangular cross-section and lie in a common plane and wherein said head part has first and second shallow beam elements one associated with each of said limbs, said shallow beam elements being disposed in said common plane, and wherein said first and second mounts are fixed to said first and second shallow beam elements respectively.

5. A modular lighting system in accordance with claim 4, wherein each said shallow beam element and the respectively associated limb is covered by a respective cover cap which is substantially triangular in side elevation and rectangular in cross-section.

6. A modular lighting system in accordance with claim 1, wherein first and second spotlight units are provided, wherein said mechanical support means therefor comprises a tubular member which is stiff in bending, which has first and second ends and which extends between and engages with respective mounts on said first and second spotlight units and wherein a second connection member is provided at each of said first and second ends of said tubular member.

7. A modular lighting system in accordance with claim 1 and further including a transformer unit, said mechanical support means being adapted to extend from said transformer unit to said spotlight unit.

8. A modular lighting system in accordance with claim 3, wherein said first and second electrical conductors are provided in said head part of said carrier part.

9. A modular lighting system in accordance with claim 3, wherein said reflector support has an external contour which extends at least substantially parallel to said limbs.

10. A modular lighting system in accordance with claim 1, wherein said carrier part consists of plastic and said reflector support of metal, and wherein said reflector support is mounted spaced apart from said carrier part.

11. A modular lighting system in accordance with claim 1, wherein each said connecting member includes a tube portion which is stiff in bending and has an axis and a central terminal member aligned with said axis and separated from said tube portion by insulating material.

12. A modular lighting system in accordance with claim 11, wherein said tube portion and said central terminal member are connected to respective ones of said power lines and are connectable, on insertion into a said mount, with said first and second conductors.

13. A modular lighting system in accordance with claim 11, wherein said mechanical support means comprises at least one carrying cable element with said connection member provided at an end thereof.

14. A modular lighting system in accordance with claim 13, wherein each said carrying cable element is led out radially from the tube portion of the associated connection member.

15. A modular lighting comprising: basic units adapted to be put together and which have the form of spotlights, and mechanically supporting connecting members which simultaneously form power supply lines, each spotlight having two diametrically oppositely disposed and identically constructed plug coupling mounts, the mounts being electrically connected with each other; each connecting member being provided, at at least one of its ends with a tension relieved plug connector matched to the coupling mounts the coupling mounts and the plug connectors being constructed in the manner of coaxial connectors; the oppositely disposed mounts of the spotlight being integrated into a carrier part on which elements of the spotlight are mountable, the carrier part comprising a head part, and two downwardly diverging limbs, electrical connection lines being provided in the head part between the plug coupling mounts and the lamp holder, the head part having formations or parts disposed in a plane of the limbs in which the plug coupling mounts are accommodated in form-locked manner and are fixed by means of securing means.

16. A lighting system in accordance with claim 15, wherein a narrow cover cap adapted to be pushed, plugged or snapped into place is respectively associated with each limb, and the associated formation or part has a triangular outline.

17. A lighting system in accordance with claim 16, wherein the height of the cover cap corresponds essentially to the height of a reflector support; the base line of the triangular cover cap extending parallel to and spaced apart from a generator line of the reflector support; the outwardly disposed angle of the triangle of the cover cap being a right angle.

* * * * *